United States Patent [19]

Clark et al.

[11] Patent Number: 4,500,401

[45] Date of Patent: Feb. 19, 1985

[54] ANODE RETRACTION DEVICE FOR A HALL-HEROULT CELL EQUIPPED WITH INERT ANODES

[75] Inventors: James M. Clark, Johnson City; Duane R. Secrist, Elizabethton; Scotty L. Hardin, Elizabethton; Stephen C. McEntyre, Elizabethton, all of Tenn.

[73] Assignee: Great Lakes Carbon Corporation, New York, N.Y.

[21] Appl. No.: 565,925

[22] Filed: Dec. 27, 1983

[51] Int. Cl.[3] ..... C25C 3/10; C25C 7/06

[52] U.S. Cl. ..... 204/225; 204/228; 204/245; 204/279

[58] Field of Search ..... 204/67, 225, 243 R, 204/244–247, 279

[56] References Cited

U.S. PATENT DOCUMENTS

| | | | |
|---|---|---|---|
| 3,329,592 | 7/1967 | Uhrenholdt | 204/225 |
| 3,434,945 | 3/1969 | Schmitt et al. | 204/245 |
| 4,039,419 | 8/1977 | Buse | 204/245 X |
| 4,210,513 | 7/1980 | Mutschler et al. | 204/245 X |

*Primary Examiner*—Donald R. Valentine

*Attorney, Agent, or Firm*—Adrian J. Good

[57] ABSTRACT

A compressed air-powered retractor for an inert anode in a Hall-Heroult cell is actuated after power interruption by a time delayed solenoid actuating a valve controlling the air supply to a cylinder connected to the anode support structure.

3 Claims, 1 Drawing Figure

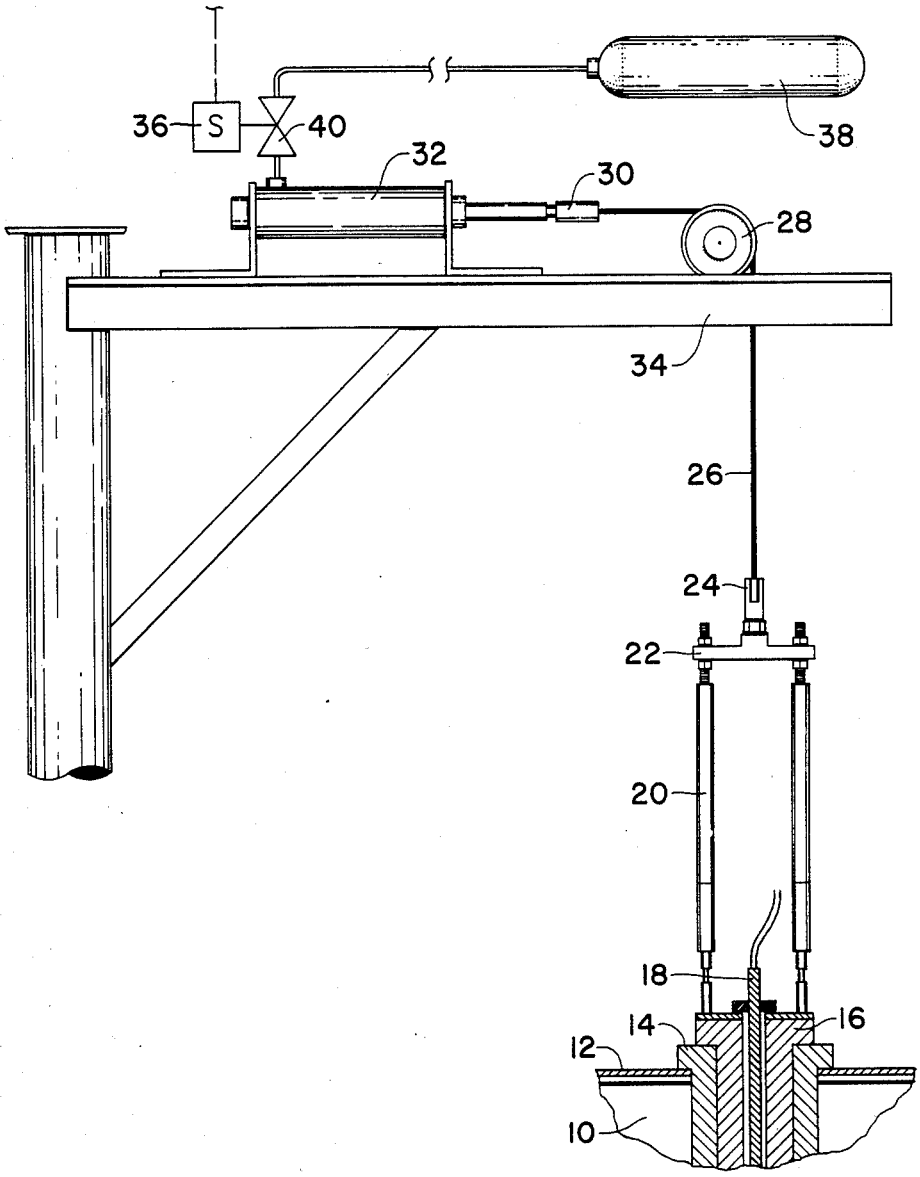
36
S
40
38
32
30
28
34
26
24
22
20
18
14
16
12
10

ANODE RETRACTION DEVICE FOR A HALL-HEROULT CELL EQUIPPED WITH INERT ANODES

BACKGROUND OF THE INVENTION

Aluminum is produced in Hall-Heroult cells by the electrolysis of alumina in molten cryolite, using conductive carbon electrodes as anodes. During the reaction the carbon anode is consumed at the rate of approximately 450 kg/mT of aluminum produced under the overall reaction $$2Al_2O_3 + 3C \xrightarrow[Na_3AlF_6]{940°-1000° C.} 4Al + 3CO_3.$$

The problems caused by the consumption of anode carbon are related to the cost of the anode consumed in the above reaction and to the impurities introduced into the melt from the carbon source. The petroleum cokes used in manufacturing the anodes usually have significant quantities of impurities, principally sulfur, silicon, vanadium, titanium, iron and nickel. Sulfur is oxidized to its oxides, causing particularly troublesome workplace and environmental pollution. The metals, particularly vanadium, are undesirable as contaminants in the aluminum metal produced. Removal of excess quantities of the impurities requires extra and costly steps when high purity aluminum is to be produced.

If no carbon were consumed in the reduction the overall reaction would be $2Al_2O_3 \rightarrow 4Al + 3O_2$ and the oxygen produced could theoretically be recovered, but more importantly no carbon would be consumed at the anode and no contamination of the atmosphere or the product would occur from the impurities present in the coke.

The aluminum industry has long sought to develop an inert ceramic anode to replace the consumable carbon anode used in Hall-Heroult electrolysis. In recent years the development effort has been accelerated and, although no instance has been reported where aluminum is produced commercially with inert anodes, significant strides have been made toward the realization of this goal. The cost of the anodes, due almost entirely to the cost of the materials from which they are made, exceeds by an appreciable amount that of baked carbon anodes now in use. However, the longer lifetime of a ceramic or cement anode, one to two years, results in a net savings in anode cost per unit of aluminum produced. From an operational viewpoint, the increased capital worth of a cell equipped with new inert anodes versus one equipped with less expensive carbon anodes justifies taking additional precautions to prevent the anodes from being damaged.

The inert anode materials disclosed to date all contain metal oxides as their principal constituent for the reason that oxides are stable to the oxygen anode product. However, most metal oxides are chemically reduced by liquid aluminum at high temperature forming $Al_2O_3$ and a metal ion which, in a Hall-Heroult cell, is co-deposited with the aluminum ions at the cathode to contaminate the aluminum product. Attack of the anode by aluminum does not occur to any appreciable extent during normal electrolysis because the oxygen gas produced at the surface of the anode acts as a protective barrier to aluminum attack and additionally stabilizes the oxide-based anode material. It is during periods when electrolysis is interrupted, e.g., during an extended power failure, that the anodes are susceptible to chemical reduction and the aluminum metal in the cell to subsequent contamination. Power outages for periods as little as five minutes may be sufficient to produce these effects, the actual time being dependent on the electrode material and the operating anode-cathode spacing. In the worst case, when power cannot be restored for several hours, the cells are subject to freeze-up which would be catastrophic to the anodes resulting in a serious financial loss.

The invention described herein, an anode retraction device, is capable of sensing a power interruption and withdrawing the anodes from the melt to preclude or minimize such damage.

SUMMARY OF THE INVENTION

The anode retraction device of the invention comprises one or more pneumatically operated actuators affixed to the busbar/anode drive mechanism and controlled by an electrical solenoid valve which is capable of sensing a power loss. The actuators function such that when power to the solenoid valve is interrupted, compressed air stored in an accumulator is admitted to the actuators to raise the anode assemblies to a predetermined locked position. The direct current solenoid valve is normally energized with the valve in the closed position. To prevent the anodes from retracting as a result of a momentary power interruption, a separate battery-operated circuit is employed in conjunction with a mechanical or electrical time delay device to maintain the solenoid valve in the energized state until the pre-set delay time has expired. Although two actuators per cell should be adequate to perform the task, the actual number is dependent on the cell design, the weight of the anodes/busbar, the size of the actuators, the accumulator pressure and other factors. The electrical sensing equipment, time delay circuitry, and gas accumulator can be constructed so as to be common to many, if not all, cells. It is understood that appropriate design modifications will be required.

The selection and placement of the actuators should provide the necessary flexibility to raise the anodes to any desired position. It may not be necessary in some cases to retract the anodes from the melt completely but rather only to remove them from the immediate proximity of the liquid aluminum pad. For example, an inert anode is expected to operate at an anode-cathode spacing of 1.9–3.8 cm which places the active surface of the anode at a depth of 10–12 cm in the melt. Withdrawing the anodes to a spacing of about 7.5 cm may be sufficient to prevent chemical attack by aluminum. If necessary to remove the anodes completely from the cell, for example, when bath freeze-up is imminent, they should be retracted to a point just above the melt yet still within the hard protective cell crust. In this position thermal shock to the anodes is minimized as are heat losses from the cell which would otherwise hasten melt freeze-up. Once power is restored, return of the busbar and anodes from the locked position to the normal operating position is accomplished by pneumatic, hydraulic, or mechanical means.

DETAILED DESCRIPTION OF THE DRAWING

A pneumatic retraction device operating on the inventive principle is illustrated in FIG. 1. The pneumatic cylinder and the linkage from the cylinder to the anode support are shown in the FIGURE. The cell 10 has a cover 12 and lava plug 14 with anode support plug 16 and power lead 18. Retractor rods 20, cross-piece 22, and clevis 24 connect to cable 26 which runs over pulley 28 to piston rod 30 in air cylinder 32 mounted on structural framework 34. Solenoid control 36 including a time delay and valve 40 admit air to the cylinder from air accumulator 38 when the power supply is interrupted for a set period of time. It is understood that the retraction device would require certain design modifications, apparent to those skilled in the art, when installed on a commercial aluminum cell.

DETAILED DESCRIPTION OF THE INVENTION

An anode retraction device similar to that shown in the FIGURE was installed on each of two laboratory reduction cells used for inert anode test purposes.

The cylinder was obtained from BIMBA Manufacturing Company, model no. MRS-313-XP. An electrical solenoid control valve produced by Skinner Precision Industries, model V53A-DB2-2100, was used to sense a power loss and to activate the cylinder by admitting compressed air to the actuator. The retraction devices functioned as designed over a two year period to provide protection for the test anodes.

The invention is not limited to usage in a Hall-Heroult aluminum reduction cell but may also be useful in other cells in which the electrodes or the cell itself may be damaged if the electrodes are allowed to remain in the electrolyte when the power supply is interrupted.

We claim:

1. A device for the automatic partial or complete retraction of an inert anode from the bath in a Hall-Heroult cell when electrical power to said cell is interrupted comprising, in combination, a compressed air reserve power source mechanically linked remotely to the anode by a pneumatic actuator which is controlled by electrical power interruption sensing means, said sensing means comprising a direct current solenoid operated valve which during normal operation is energized to the closed position by a D.C. power supply and following a power failure is energized by a battery operated circuit which contains a mechanical or electrical time delay mechanism, said time delay mechanism set to open the solenoid valve a predetermined period after electrical power is interrupted to said cell, admitting air to said actuator from said power source to retract said anode.

2. The device of claim 1 wherein a time delay means delays the retraction of the anode for a period of five minutes or more after power is interrupted.

3. A method for automatically partially or completely retracting an inert anode from the melt in a Hall-Heroult cell after power interruption using the device of claim 1.

* * * * *